US007160217B2

(12) United States Patent
Sohm

(10) Patent No.: US 7,160,217 B2
(45) Date of Patent: Jan. 9, 2007

(54) BROADHEAD BLADE ASSEMBLY COMPRISING AN IMPROVED BLADE DESIGN

(76) Inventor: Michael Sohm, PO Box 144, Otis, KS (US) 67565

( * ) Notice: Subject to any disclaimer, the term of this patent is extended or adjusted under 35 U.S.C. 154(b) by 69 days.

(21) Appl. No.: 10/906,286

(22) Filed: Feb. 11, 2005

(65) Prior Publication Data

US 2006/0183578 A1 Aug. 17, 2006

(51) Int. Cl.
*F42B 6/08* (2006.01)

(52) U.S. Cl. ..... 473/583

(58) Field of Classification Search ..... 473/578, 473/583, 584

See application file for complete search history.

(56) References Cited

U.S. PATENT DOCUMENTS

| | | | | |
|---|---|---|---|---|
| 2,820,637 | A * | 1/1958 | La Foud | 473/583 |
| 3,021,138 | A * | 2/1962 | Smith | 473/584 |
| 3,419,273 | A * | 12/1968 | Rudzinski | 473/583 |
| 3,995,860 | A * | 12/1976 | Manspeaker | 473/584 |
| 4,349,202 | A * | 9/1982 | Scott | 473/584 |
| 5,636,845 | A * | 6/1997 | Newnam | 473/583 |
| 6,605,012 | B1 | 8/2003 | Muller | |
| 6,726,581 | B1 | 4/2004 | Muller | |
| 6,743,128 | B1 * | 6/2004 | Liechty, II | 473/583 |
| 6,939,258 | B1 | 9/2005 | Muller | |
| 2005/0181898 | A1 | 8/2005 | Muller | |
| 2006/0030439 | A1 | 2/2006 | Muller | |

OTHER PUBLICATIONS

Cabelas Archery Catalog, May 2005, p. 55, Published in: US.
Cabelas Archery Catalog, May 2005, p. 53, Published in: US.
Cabelas Archery Catalog, May 2005, p. 59, Published in: US.
Cabelas Archery Catalog, May 2005, p. 57, Published in: US.
New Archery Products 2005 Catalog, Jan. 2005, p. 12, Published in: US.
Wasp Catalog, Jan. 2005.
Inside ARcher Magazine, Jun. 2005, p. 85.

* cited by examiner

*Primary Examiner*—John A. Ricci
(74) *Attorney, Agent, or Firm*—Oppedahl & Olson LLP

(57) ABSTRACT

A broadhead assembly includes a substantially planar metal blade that defines a plane of symmetry relative to the blade. The blade includes first and second sharp edges which are symmetric relative to the plane of symmetry. The first and second sharp edges nearing each other and defining a tip area therebetween/and defining a cutting bevel of between 17 and 30 degrees. The tip area is characterized by third and fourth sharp edges which are symmetric relative to the plane of symmetry. The third edge is adjacent to the first edge at a first inflection point and adjacent to the fourth edge at the tip area. The fourth edge is adjacent to the third edge at the tip area and the second edge at a second inflection point, wherein the angle formed between the first inflection point, the tip area, and the second inflection point is between 40 and 65 degrees. The first edge and the second edge and the third edge and the fourth edge each have a length wherein each of the first and second sharp edges extend at least an inch in length. The length of the third edge is between ⅓ and ⅐ of the length of the first edge and the length of the fourth edge is between ⅓ and ⅐ of the length of the second edge. Each of the third edge and the fourth edge define a penetrating bevel of between 20 and 35 degrees.

14 Claims, 10 Drawing Sheets

BROADHEAD BLADE ASSEMBLY COMPRISING AN IMPROVED BLADE DESIGN

BACKGROUND OF THE INVENTION

Archery hunting and target shooting has been known for thousands of years. Since its inception until the present time two of the most important items of archery include the bow and the arrow. Several improvements with regard to each of these items have been made leading to a substantial industry geared toward supplying sporting outdoorsmen with top-of-the-line advancements in equipment that improve, among other things, accuracy and killing potential.

An arrow typically comprises a shaft and an arrowhead herein known as a broadhead. It has been recognized that a broadhead must contain certain characteristics to allow an archer to attack with accuracy and effectively penetrate the target. These broadhead characteristics include among others shape, weighting, sharpness, and materials of construction.

Several advances have been found with regard to improving each these characteristics in the broadheads of the past. Unfortunately it was found that the broadheads of the past were lacking in point strength and penetrating ability once the arrow reached the target.

The present invention solves this and other problems of broadheads in the prior art by providing a new blade design for a broadhead that enhances point strength and target penetrating ability.

SUMMARY OF THE INVENTION

It has been found that the present invention enhances point strength of a broadhead blade and increases its penetrating and cutting ability. It has also been found that the blade design of the present invention provides a broadhead that may be reused thereby reducing the cost for an archer associated with buying replacement blades and new broadheads.

The present invention provides a new and novel broadhead assembly comprising a substantially planar metal blade that defines a plane of symmetry relative to the blade. The blade comprises first and second sharp edges which are symmetric relative to the plane of symmetry. The first and second sharp edges nearing each other and defining a tip area therebetween and defining a cutting bevel of between 17 and 30 degrees. The tip area is characterized by third and fourth sharp edges which are symmetric relative to the plane of symmetry. The third edge is adjacent to the first edge at a first inflection point and adjacent to the fourth edge at the tip area. The fourth edge is adjacent to the third edge at the tip area and the second edge at a second inflection point, wherein the angle formed between the first inflection point, the tip area, and the second inflection point is between 40 and 65 degrees. The first edge, the second edge, the third edge, and the fourth edge each have a length wherein each of the first and second sharp edges extend at least an inch in length. The length of the third edge is between ⅓ and ⅐ of the length of the first edge and the length of the fourth edge is between ⅓ and ⅐ of the length of the second edge. Each of the third edge and the fourth edge define a penetrating bevel of between 20 and 35 degrees.

BRIEF DESCRIPTION OF THE DRAWING

FIG. 3(*a*) shows a cross-section of the blade in FIG. 3;

DETAILED DESCRIPTION OF THE INVENTION

It has been found that the blade design of the present invention enhances the point strength of a broadhead blade and increases its penetrating and cutting ability. It has also been found that the blade design of the present invention provides a broadhead that may be reused thereby reducing the cost for an archer associated with buying replacement blades and new broadheads.

In accordance with an embodiment of the present invention, a broadhead blade assembly is provided comprising a blade, characterized in that the blade is metal; the blade characterized as substantially planar, the blade defining a plane of symmetry relative to the blade; the blade comprising first and second sharp edges, the first and second sharp edges symmetric relative to the plane of symmetry; the first and second sharp edges nearing each other and defining a tip area therebetween; each of the first and second sharp edges defining a cutting bevel of between 17 and 30 degrees; the tip area characterized by third and fourth sharp edges, the third and fourth sharp edges symmetric relative to the plane of symmetry; the third edge adjacent to the first edge at a first inflection point and adjacent to the fourth edge at the tip area; the fourth edge adjacent to the third edge at the tip area and the second edge at a second inflection point; wherein the angle formed between the first inflection point, the tip area, and the second inflection point is between 40 and 65 degrees; the first edge and the second edge and the third edge and the fourth edge each having a length; each of the first and second sharp edges extending at least an inch in length; the length of the third edge characterized as between ⅓ and ⅐ of the length of the first edge; the length of the fourth edge characterized as between ⅓ and ⅐ of the length of the second edge; and each of the third edge and the fourth edge defining a penetrating bevel of between 20 and 35 degrees.

The blades of the present invention are made from a metal which may be stainless steel, carbon steel, and titanium. While these metals contain desirable properties such as sufficient hardness to provide a rigid blade for the present invention, other metals or materials may be used and do not depart in scope from the present invention.

Figure 1:
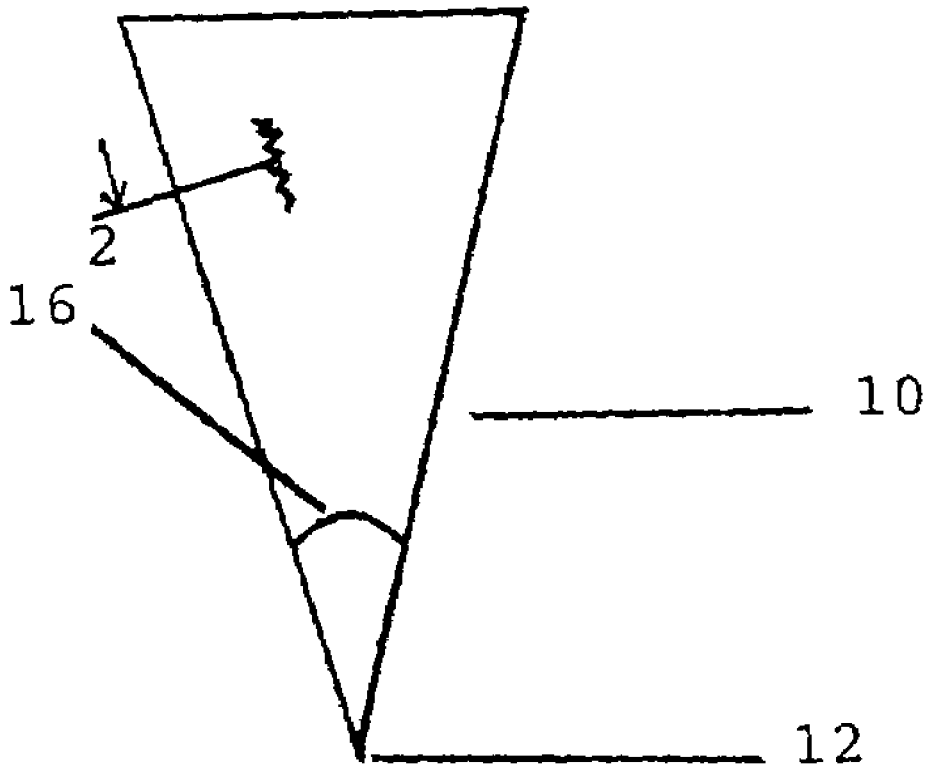
FIG. 1 shows a top view of a blank used in the production of the blade of the present invention.
Figure 2:
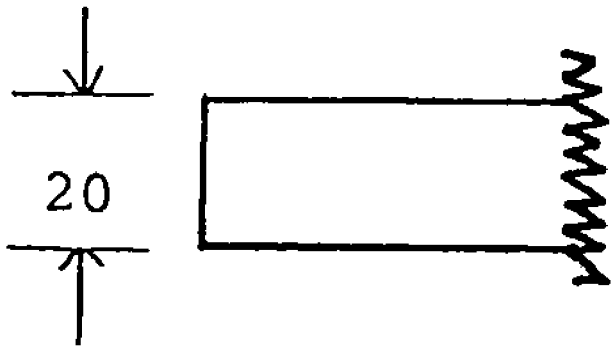
FIG. 2 shows a cross-section of the blank depicted in FIG. 1.

FIG. 1 shows a top view of a starting blank 10 with point 12. This blank is typically stamped out of a sheet of a metal selected from the above list of thickness 20 typically between 0.025" and 0.055", more preferably between 0.030" and 0.045", and most preferably about 0.035" as shown in FIG. 2. Angle 16 can be anywhere between 13 to 50 degrees, more preferably between 21 and 40 degrees, with 30 degrees being most preferred.

Figure 3:
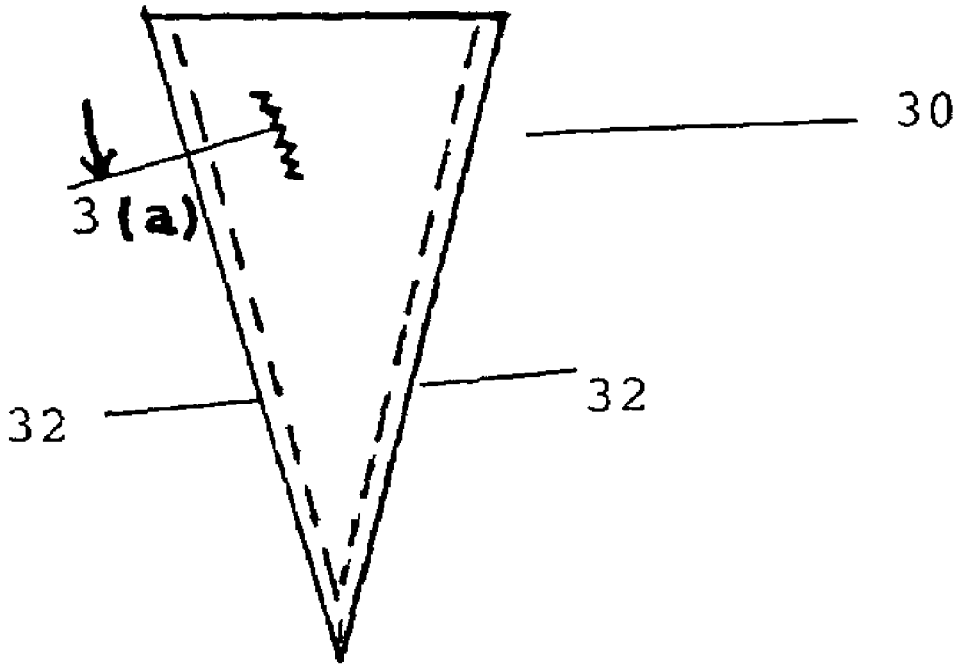
FIG. 3 shows a top view of a cut-on-contact blade of the prior art.
Figure 3A:
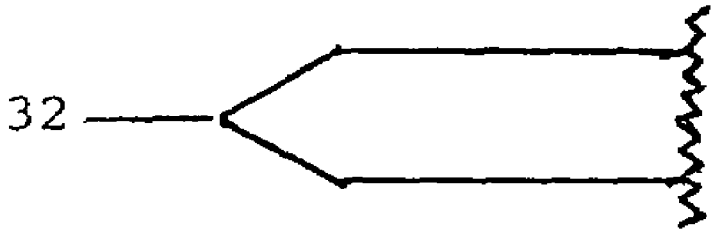

FIG. 3 shows a top view of a cut-on-contact blade 30 of the prior art. Blade 30 is produced by machining blank 10 of FIG. 1 to provide cutting edges 32 as shown in FIG. 3(*a*). One method of producing cutting edges 32 is to place blank 10 in a jig that is set to a predetermined angle and then introducing blank 10 to a series of grinding surfaces thereby producing cutting edges 32.

Figure 4:
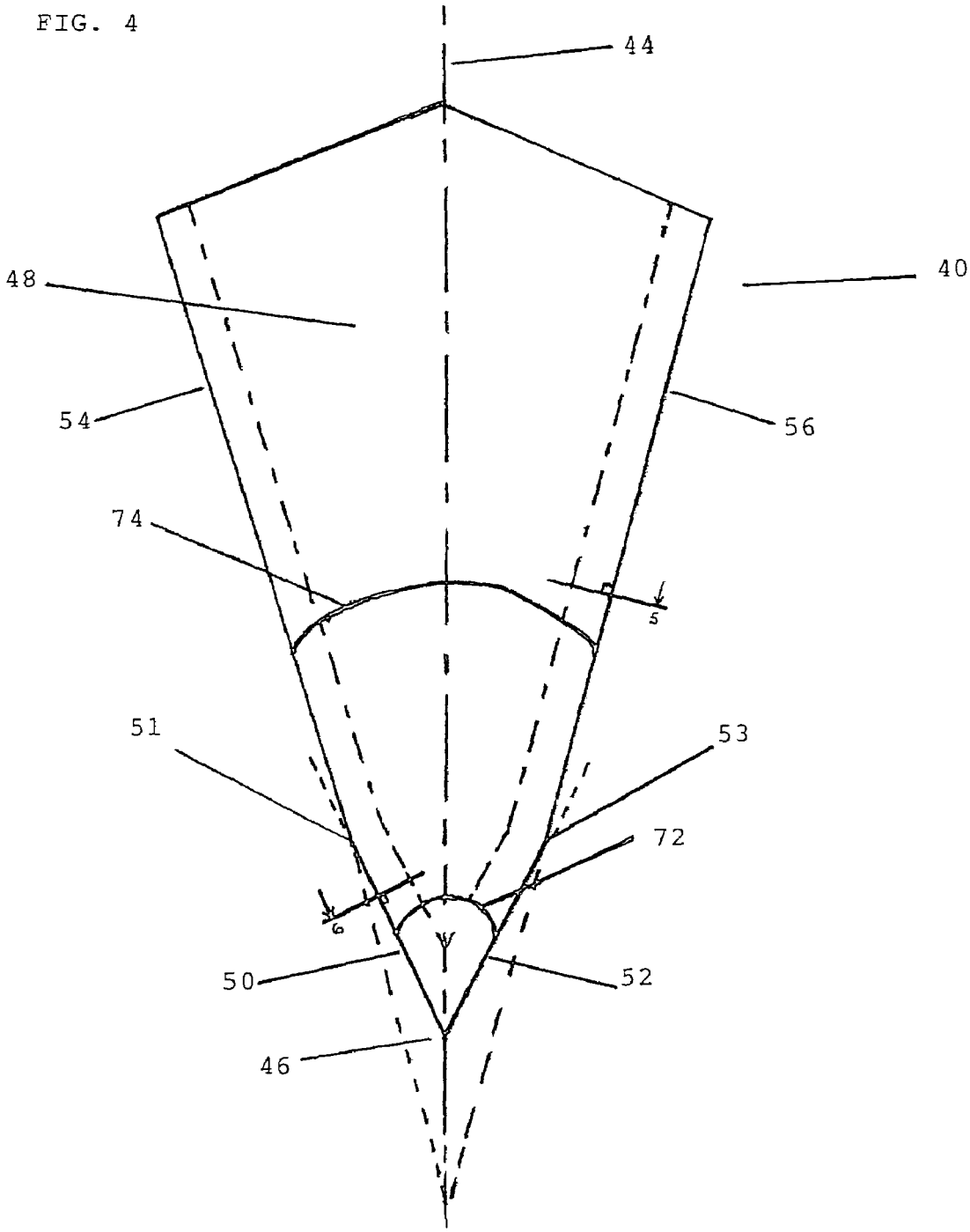
FIG. 4 shows a top view of an embodiment of the present invention.
Figure 5:
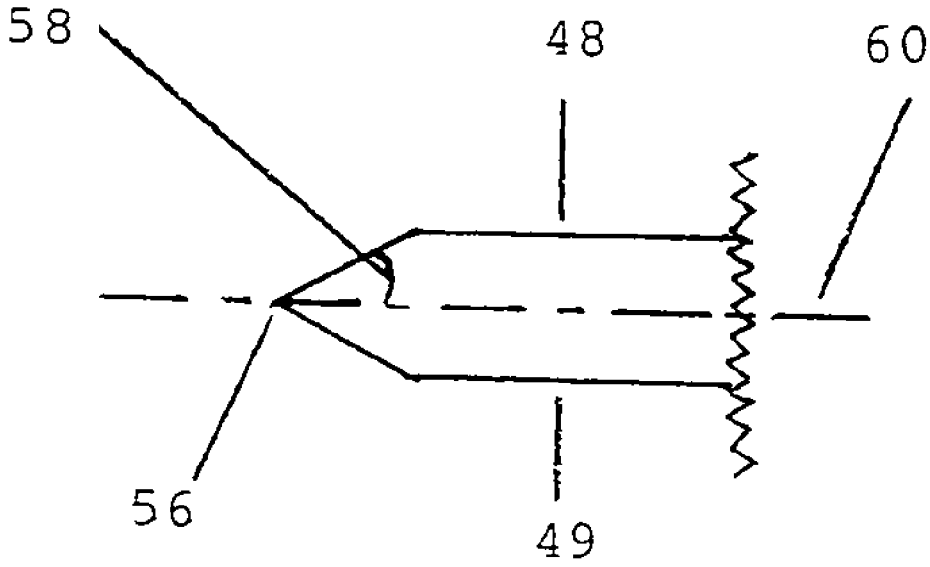
FIG. 5 shows a cross-section of FIG. 4.
Figure 6:
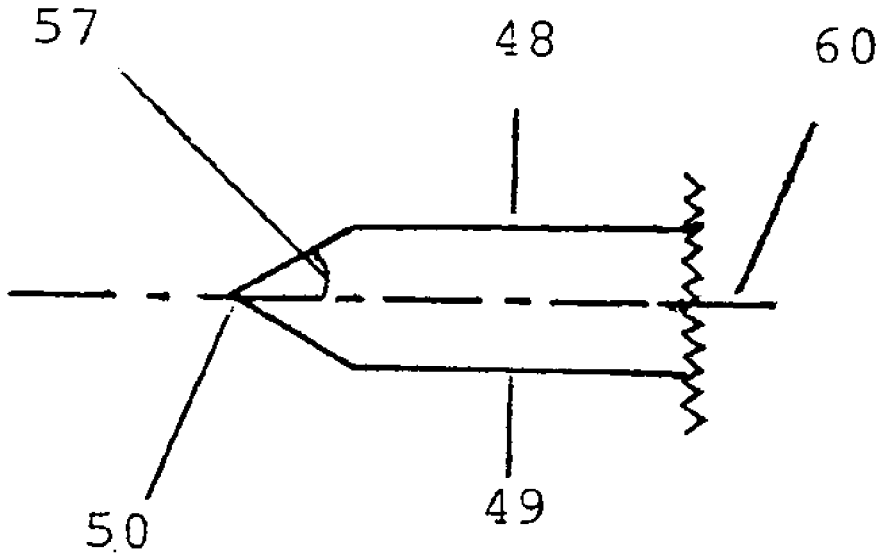
FIG. 6 shows yet another cross section of FIG. 4.

FIG. 4 shows a top view of a blade 40 according to the present invention. Blade 40 can be produced by cutting sharp edges 50 and 52 from cutting edges 32 on blade 30 of FIG. 3. This creates a first sharp edge 54, a second sharp edge 56, a third sharp edge 50, a fourth sharp edge 52, a first inflection point 51, and a second inflection point 53. Blade 40 has a tip area 46, a top surface 48, and a bottom surface 49 (shown in FIGS. 5 and 6) substantially parallel to the top surface 48.

The tip area of the blade of the present invention is formed by cutting sharp edges 50 and 52. Each of these sharp edges define a penetrating bevel typically equal to or steeper in angle 57 (see FIG. 6) than the cutting bevel defined by each of sharp edges 54 and 56 (i.e. angle 58 shown in FIG. 5). It is contemplated that cutting bevel angle 58 in FIG. 5 be anywhere in the range of 17 to 30 degrees relative to the horizontal center plane, or more preferably in the range of 18 to 25 degrees, with a preferred angle being 19 degrees. It is further contemplated that the penetrating bevel angle 57 in FIG. 6 be in a range of 20 to 35 degrees with respect to the horizontal center plane, or more preferably in a range of 22 to 30 degrees, with a most preferred angle being 25 degrees.

FIG. 4 also shows the longitudinal symmetrical center plane 44 of blade 40 extending out of the page in FIG. 4. Cutting edges 50, 52 are positioned relative to the longitudinal center plane 44 so as to be steeper in angle 72 (i.e. the angle formed by the first inflection point 51, the tip area 46, and the second inflection point 53) than angle 74 of sharp edges 54 and 56 with respect to the longitudinal symmetrical center plane 44. It is contemplated that angle 72 is anywhere between 40 and 65 degrees and more preferably between 45 and 57 degrees, with a most preferred angle being 50 degrees, while angle 74 is anywhere from 13 to 50 degrees, or more preferably from 20 to 40 degrees, with a most preferred angle being 30 degrees, with the proviso that angle 72 is typically greater than angle 74.

Figure 7:
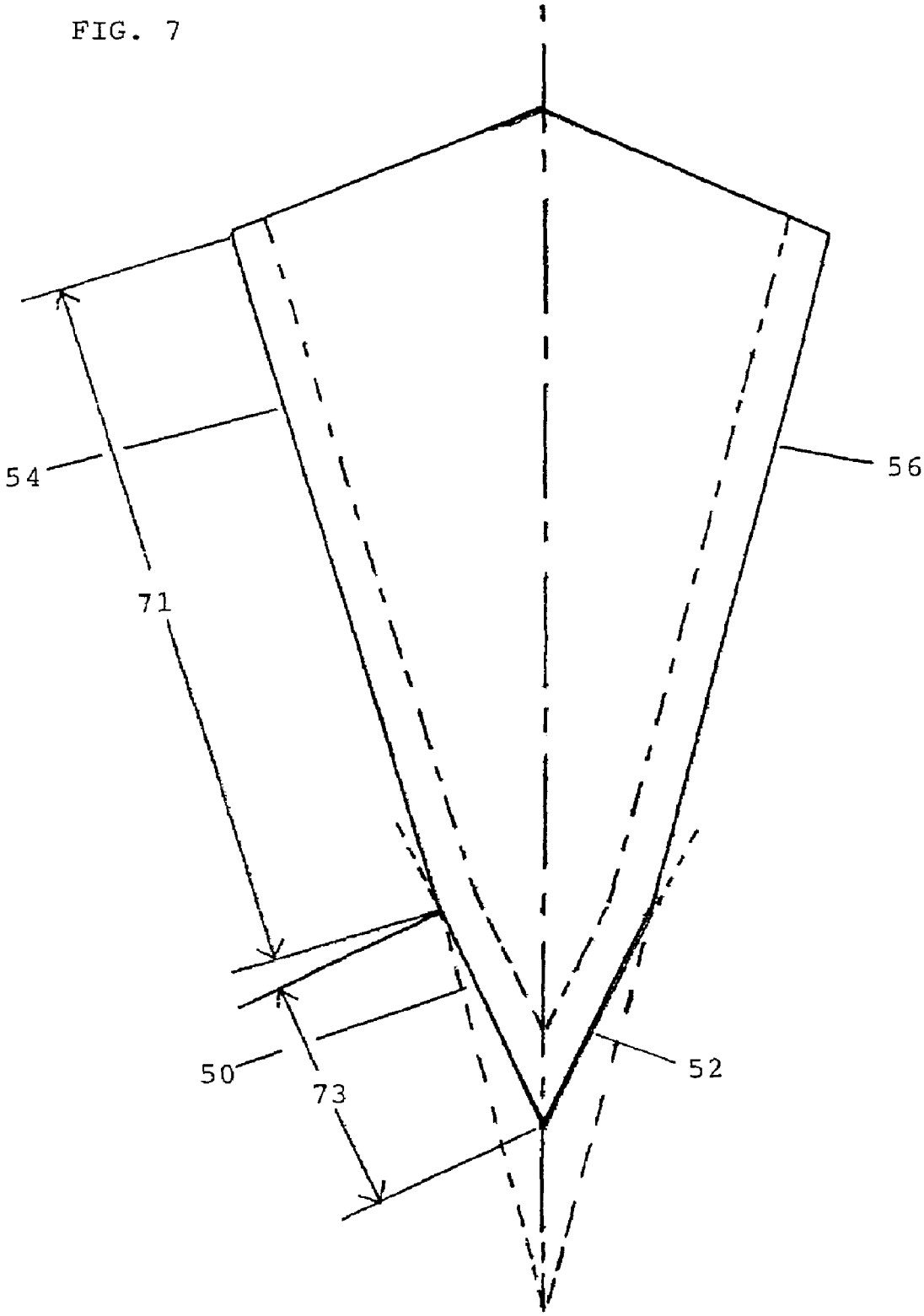
FIG. 7 shows a top view of an embodiment of the present invention.

The present invention provides for different length blades. FIG. 7 shows blade 40 as in FIG. 4. Each of sharp edges 54 and 56 extend at least in length 71 1" with a preferred length of 1½". It is contemplated that the length 73 of sharp edges 50 and 52 compared to the length of sharp edges 54 and 56 be in a ratio of anywhere between 1:3 to 1:7, or more preferably in a range of 1:4 to 1:6.5, with a most preferred ratio being 1:6. Typically length 73 is one-fourth of an inch.

Figure 8:
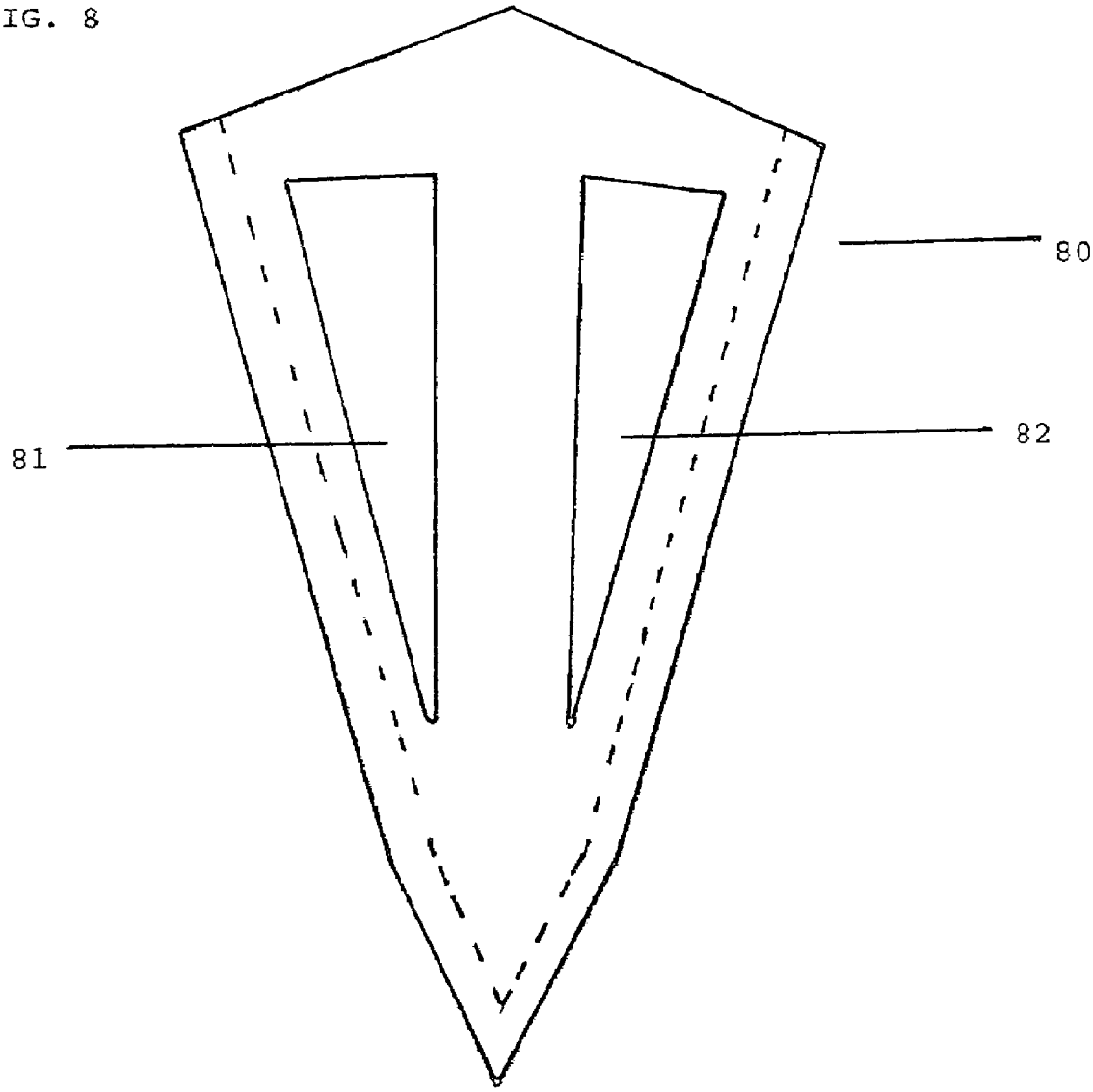
FIG. 8 shows a top view of an embodiment of the present invention.

FIG. 8 shows yet another blade 80 in accordance with the present invention. Blade 80 has vents 81 and 82 cut within the blade from one surface to the other. Vents 81 and 82 serve the purpose of decreasing the weight of blade 80 as well as providing desirable aerodynamic effects that can lead to greater accuracy of an arrow holding the blade assembly of the present invention.

Figure 9:
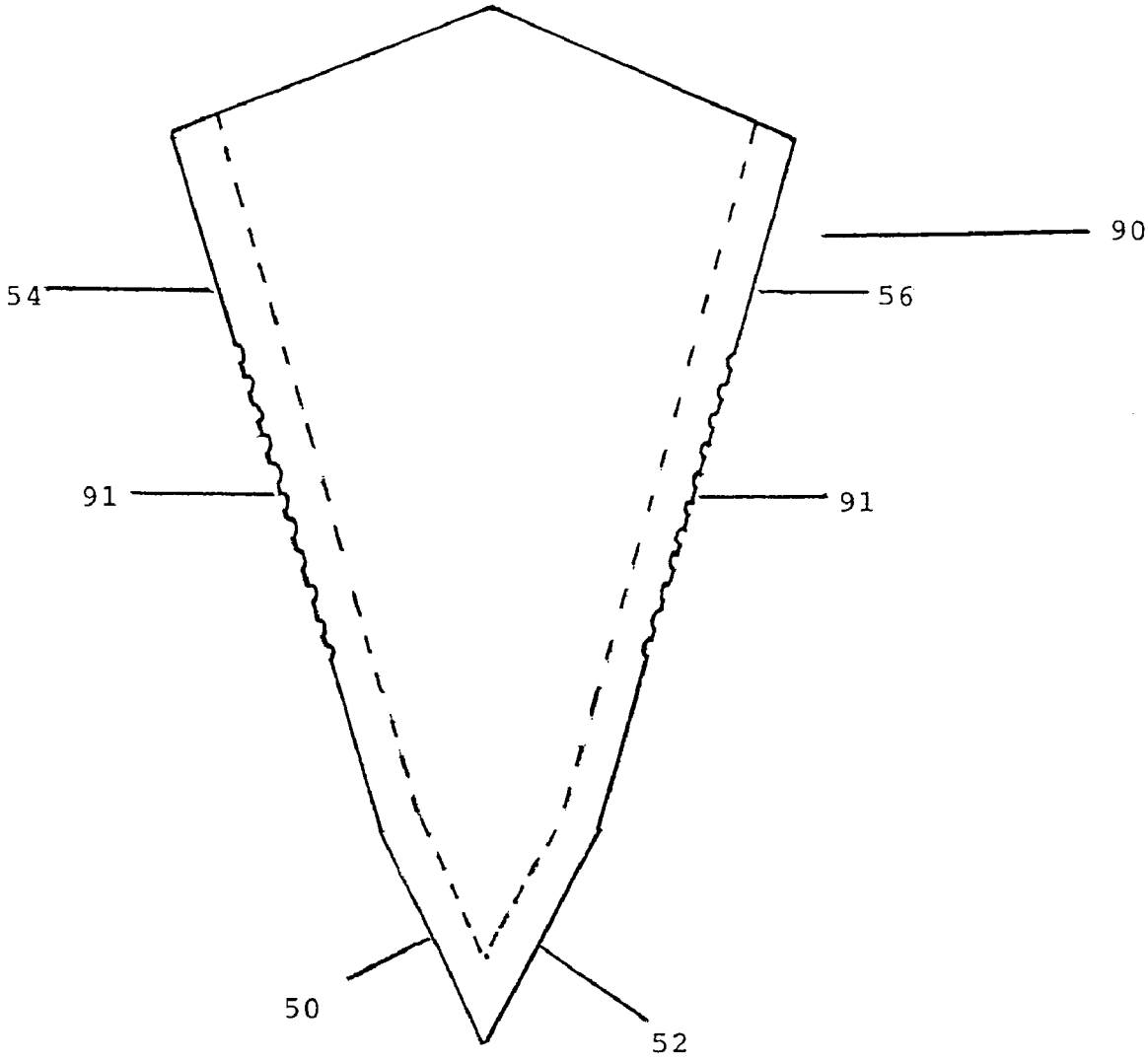
FIG. 9 shows a top view of an embodiment of the present invention.

FIG. 9 shows yet another embodiment of the present invention. Blade 90 contains serrations 91 on sharp edges 54 and 56. It is contemplated that sharp edges 54, 56, 50 and 52 are straight. It is further contemplated that the sharp edges 54 and 56 be convex or concave.

Figure 10:
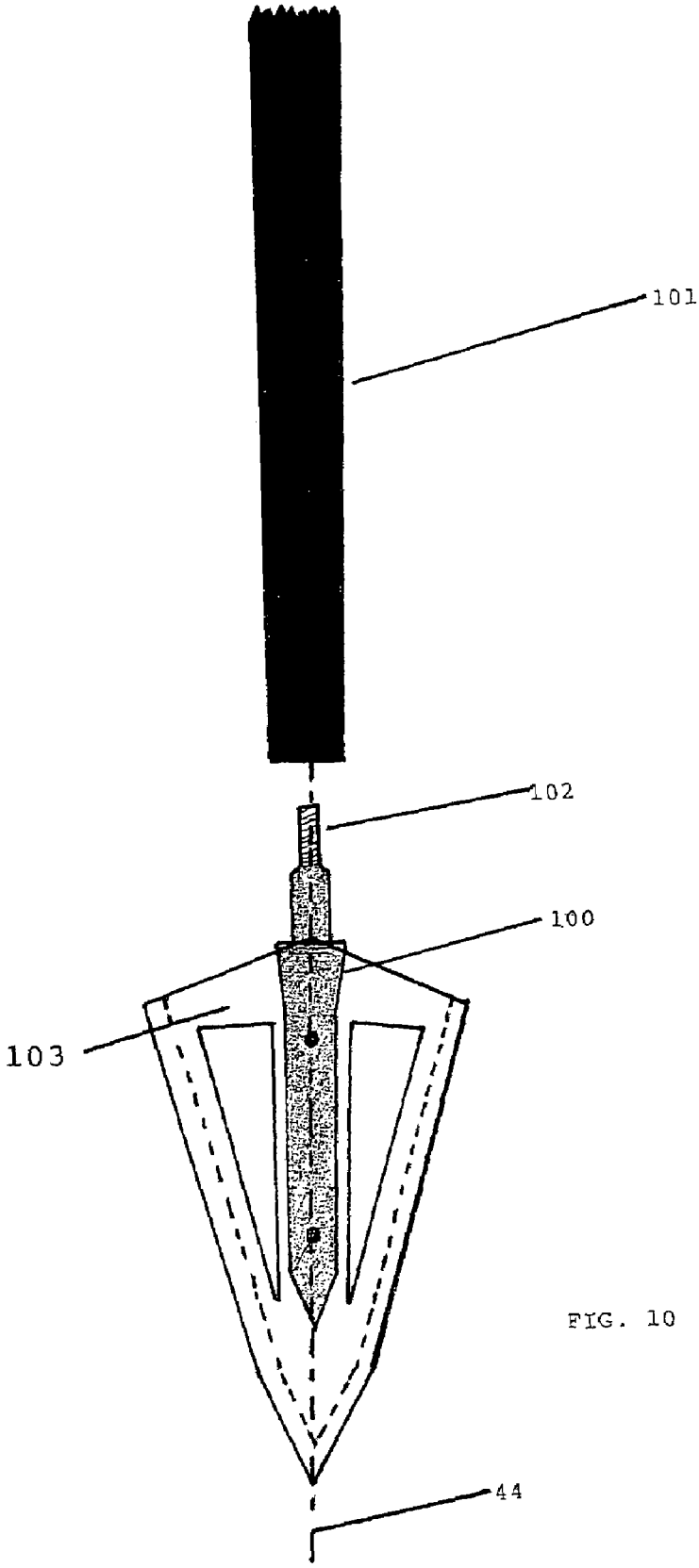
FIG. 10 shows a top view of a blade assembly of the present invention in exploded view with an arrow shaft.

An embodiment of the present invention depicted in FIG. 10 shows the broadhead assembly of the present invention further comprising a ferrule 100 attached to the blade 103. The ferrule extends axially in a direction away from the tip area and coplanar with the blade 103 and within the plane of symmetry 44. The ferrule 100 further comprises attachment means at an end of the ferrule away from the tip area. The attachment means of ferrule 100 are not particularly limited and include among others glue or a preferred screw and thread mechanism 102. FIG. 10 also shows arrow shaft 101.

Figure 11:
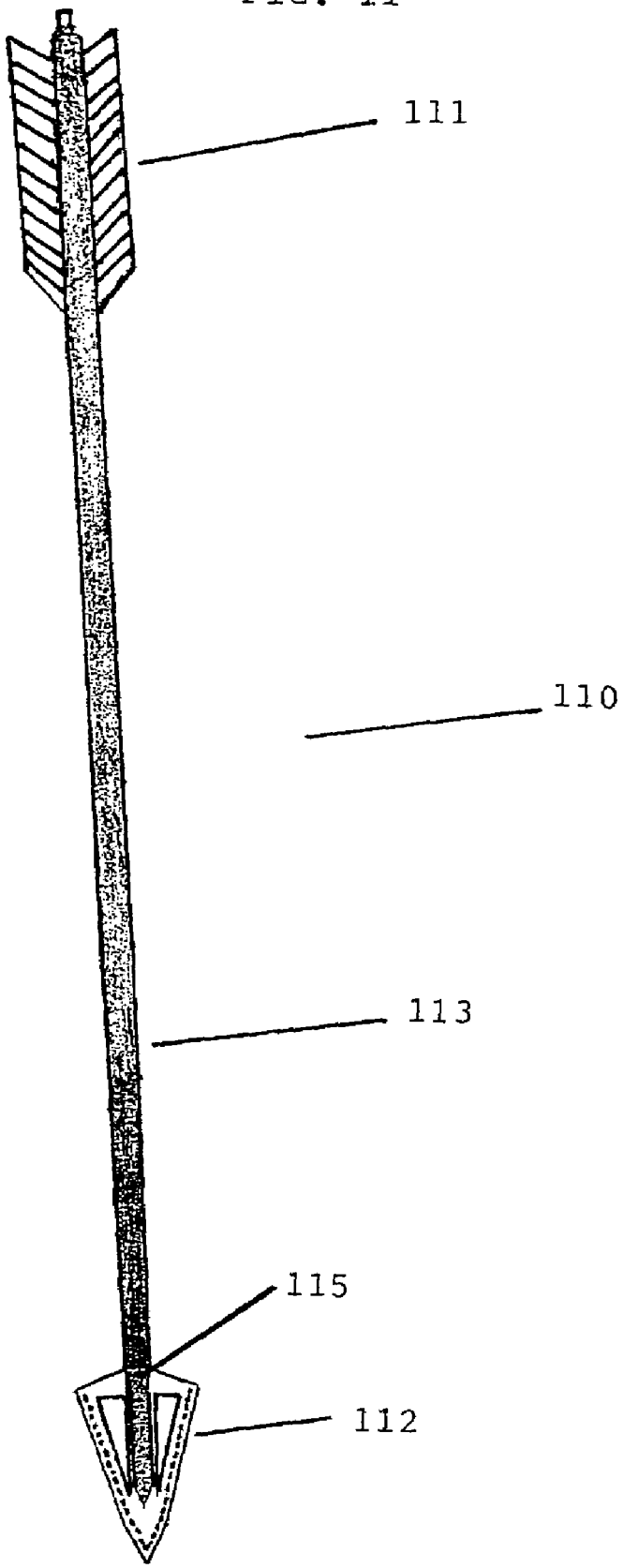
FIG. 11 shows a top view of a blade assembly of the present invention attached to an arrow shaft.

FIG. 11 is a top view of arrow 110 comprising an arrow shaft 113 attached to the ferrule 115 which is coaxial therewith. The arrow shaft has fletching 111 at an end away from the ferrule 115.

Figure 12:
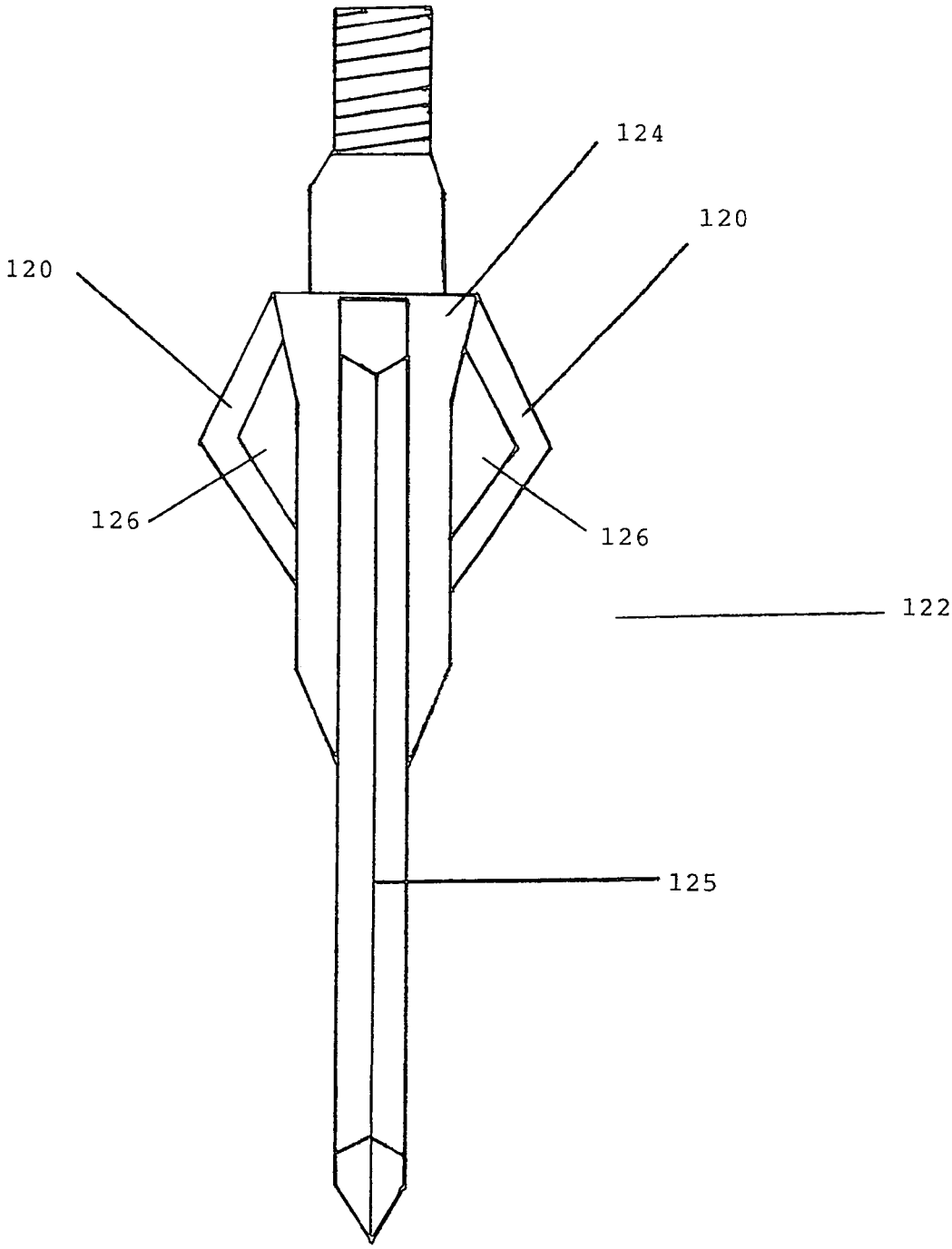
FIG. 12 shows a side view of a blade assembly of the present invention.

FIG. 12 is a side view of another embodiment of the present invention. Ferrule 124 may further have a slot for receiving and securing a second blade herein known as a bleeder blade 120 to the broadhead 122 in a plane that is different from that of the blade 125 of the present invention. The bleeder blade 120 depicted in FIG. 12 comprises vents 126. The ferrule is typically made of metals including aluminum and steel. In a particularly preferred embodiment the ferrule is made from anodized aluminum and is secured with steel screws which are countersunk.

For aerodynamic reasons the blades of the present invention should be symmetrical with respect to the longitudinal center plane and the horizontal center plane.

Those skilled in the art will have no difficulty devising myriad obvious variations and improvements to the invention, all of which are intended to be encompassed within the scope of the claims which follow.

What is claimed is:

1. A broadhead assembly comprising a blade, characterized in that the blade is metal;

the blade characterized as substantially planar, the blade defining a plane of symmetry relative to the blade;

the blade comprising first and second sharp edges, the first and second sharp edges symmetric relative to the plane of symmetry;

the first and second sharp edges nearing each other and defining a tip area therebetween;

each of the first and second sharp edges defining a cutting bevel of between 17 and 30 degrees;

the tip area characterized by third and fourth sharp edges, the third and fourth sharp edges symmetric relative to the plane of symmetry;

the third edge adjacent to the first edge at a first inflection point and adjacent to the fourth edge at the tip area;

the fourth edge adjacent to the third edge at the tip area and the second edge at a second inflection point;

wherein an angle formed between the first inflection point, the tip area, and the second inflection point is between 40 and 65 degrees;

the first edge and the second edge and the third edge and the fourth edge each having a length;

each of the first and second sharp edges extending at least an inch in length;

the length of the third edge characterized as between ⅓ and ⅐ of the length of the first edge;

the length of the fourth edge characterized as between ⅓ and ⅐ of the length of the second edge; and each of the third edge and the fourth edge defining a penetrating bevel of between 20 and 35 degrees;

wherein the first edge and the second edge are straight;

further comprising a ferrule attached to the blade, the ferrule extending axially in a direction away from the tip area and coplanar with the blade and within the plane of symmetry, the ferrule farther comprising attachment means at an end of the ferrule away from the tip area.

2. The broadhead assembly of claim 1 further comprising an arrow shaft attached to the ferrule and coaxial therewith, the arrow shaft having fletching at an end away from the ferrule.

3. The broadhead assembly of claim 1 further comprising, a second metal substantially planar blade assembly having a first and second sharp edge disposed within the ferrule such the first and second sharp edge of the second blade extend outward from the ferrule in a different plane from the first blade assembly.

4. The broadhead assembly of claim 1, wherein the ferrule is made of anodized aluminum.

5. The broadhead assembly of claim 1 wherein the blade comprises carbon steel.

6. The broadhead assembly of claim 1 wherein the blade comprises stainless steel.

7. The broadhead assembly of claim 1 wherein the blade comprises titanium.

8. The broadhead assembly of claim 1 wherein the first edge and the second edge further comprise serrations.

9. The broadhead assembly of claim 1 wherein the penetrating bevel defined by each of the third and the fourth sharp edges is greater in angle than the cutting bevel defined by each of the first and the second sharp edges.

10. The broadhead assembly of claim 9 wherein each of the first and second sharp edges define a cutting bevel of 19 degrees.

11. The broadhead assembly of claim 9 wherein each of the third and fourth sharp edges define a penetrating bevel of 25 degrees.

12. The broadhead assembly of claim 1 wherein the angle formed between the first inflection point, the tip area, and the second inflection point is 50 degrees.

13. The broadhead assembly of claim 1 further comprising a first and a second vent.

14. A method of making an arrow comprising, securing a broadhead assembly onto an arrow shaft, the broadhead assembly comprising a blade, characterized in that the blade is metal;

the blade characterized as substantially planar, the blade defining a plane of symmetry relative to the blade;

the blade comprising first and second sharp edges, the first and second sharp edges symmetric relative to the plane of symmetry;

wherein the first edge and the second edge are straight;

the broadhead farther comprising a ferrule attached to the blade, the ferrule extending axially in a direction away from the tip area and coplanar with the blade and within the plane of symmetry, the ferrule further comprising attachment means at an end of the ferrule away from the tip area;

the first and second sharp edges nearing each other and defining a tip area therebetween;

each of the first and second sharp edges defining a cutting bevel of between 17 and 30 degrees;

the tip area characterized by third and fourth sharp edges, the third and fourth sharp edges symmetric relative to the plane of symmetry;

the third edge adjacent to the first edge at a first inflection point and adjacent to the fourth edge at the tip area;

the fourth edge adjacent to the third edge at the tip area and the second edge at a second inflection point;

wherein the angle formed between the first inflection point, the tip area, and the second inflection point is between 40 and 65 degrees;

the first edge and the second edge and the third edge and the fourth edge each having a length;

each of the first and second sharp edges extending at least an inch in length;

the length of the third edge characterized as between ⅓ and ⅐ of the length of the first edge;

the length of the fourth edge characterized as between ⅓ and ⅐ of the length of the second edge; and each of the third edge and the fourth edge defining a penetrating bevel of between 20 and 35 degrees, thereby making an arrow.

* * * * *